US010392861B2

(12) United States Patent
Geiger

(10) Patent No.: US 10,392,861 B2
(45) Date of Patent: Aug. 27, 2019

(54) BRACKET AND SUPPORT FOR EXTENDED LENGTH SHADE

(71) Applicant: Geigtech East Bay LLC, Charleston, SC (US)

(72) Inventor: James Geiger, Charleston, SC (US)

(73) Assignee: Geigtech East Bay LLC, Charleston, SC (US)

( * ) Notice: Subject to any disclaimer, the term of this patent is extended or adjusted under 35 U.S.C. 154(b) by 211 days.

(21) Appl. No.: 15/404,883

(22) Filed: Jan. 12, 2017

(65) Prior Publication Data

US 2018/0195342 A1 Jul. 12, 2018

(51) Int. Cl.

| | |
|---|---|
| ***E06B 9/42*** | (2006.01) |
| ***E04F 10/06*** | (2006.01) |
| ***E06B 9/50*** | (2006.01) |

(52) U.S. Cl.

CPC ..... *E06B 9/42* (2013.01); *E04F 10/0662* (2013.01); *E04F 10/0677* (2013.01); *E06B 9/50* (2013.01)

(58) Field of Classification Search

CPC ... A47H 1/10; A47H 1/13; A47H 1/14; A47H 1/142; A47H 1/144; A47H 1/18; E06B 9/08; E06B 9/11; E06B 9/17; E06B 9/171; E06B 9/17076; E06B 9/174; E06B 9/40; E06B 9/42; E06B 9/50; E06B 9/56; E06B 2009/1716

USPC ..... 160/23.1, 41, 120, 121.1, 238, 247, 246, 160/323.1, 368.1, 903

See application file for complete search history.

(56) References Cited

U.S. PATENT DOCUMENTS

| | | | | | |
|---|---|---|---|---|---|
| 1,681,016 | A * | 8/1928 | Schmidt | E04F 10/0662 | 242/595.1 |
| 1,742,549 | A | 1/1930 | MacArthur et al. | | |
| 1,882,623 | A * | 10/1932 | Kasper | E06B 9/50 | 160/299 |
| 2,220,311 | A * | 11/1940 | Anton | E04F 10/0677 | 242/595.1 |
| 2,248,414 | A * | 7/1941 | Schane | A47H 3/12 | 242/595.1 |

(Continued)

FOREIGN PATENT DOCUMENTS

| | | | |
|---|---|---|---|
| ES | 2298025 | A1 | 5/2008 |
| KR | 100730339 | B1 * | 6/2007 |
| KR | 100730339 | B1 | 6/2007 |

OTHER PUBLICATIONS

International Search Report and Written Opinion regarding PCT/US2018/013089, dated Mar. 28, 2018, 18 pages.

*Primary Examiner* — Johnnie A. Shablack

(74) *Attorney, Agent, or Firm* — Kim and Lahey Law Firm, LLC; Douglas W. Kim

(57) ABSTRACT

A shade bracket and support system includes a shade, a shade tube, at least two bracket assemblies, and a plurality of roller assemblies. The shade is movable between a retracted position and an extended position. The shade tube is coupled to the shade and rotates in a first direction to retract the shade and a second direction to extend the shade. The bracket assemblies mount to a structure and support the shade tube and shade. The roller assemblies are provided between the bracket assemblies and support the shade and the shade tube along a longitudinal axis of the shade tube. At least one of the roller assemblies rotates in the same direction as the shade tube when the shade is being retracted or extended.

7 Claims, 8 Drawing Sheets

(56) References Cited

U.S. PATENT DOCUMENTS 2,326,642 A * 8/1943 Heiser ..... E04F 10/0677 242/595.1
2,870,831 A * 1/1959 Peselnick ..... E06B 9/24 160/113
3,065,785 A * 11/1962 Taber ..... A47H 23/04 160/237
3,421,568 A * 1/1969 Youngs ..... E06B 9/174 160/267.1
3,900,063 A * 8/1975 Roller ..... E06B 9/17 160/310
3,912,187 A * 10/1975 Woelky ..... B65H 16/005 242/370
4,064,648 A * 12/1977 Cary ..... A01G 9/227 47/17
4,390,054 A 6/1983 Niibori et al.
4,494,707 A * 1/1985 Niibori ..... A01G 9/227 242/390.2
5,427,168 A * 6/1995 Lohausen ..... E04F 10/0618 160/22
5,862,851 A * 1/1999 Stoebich ..... A62C 2/10 160/120
6,357,507 B1 * 3/2002 Stoebich ..... A62C 2/10 160/121.1
6,361,229 B1 * 3/2002 Shinga ..... B65H 75/08 160/323.1
7,077,458 B2 * 7/2006 Malott ..... B60P 3/34 296/171
D669,771 S 10/2012 Geiger
8,602,389 B2 * 12/2013 Nunley ..... B66C 23/48 254/133 R
8,789,576 B2 * 7/2014 Krueger ..... A62C 2/18 160/133
D712,727 S 9/2014 Geiger
2008/0053628 A1 * 3/2008 Anderson ..... E06B 9/264 160/238
2018/0347274 A1 * 12/2018 Berman ..... E06B 9/84

* cited by examiner

BRACKET AND SUPPORT FOR EXTENDED LENGTH SHADE

BACKGROUND

The present application relates generally to the field of shade and screen systems. More particularly, the present application relates to extendable and retractable shade systems for supporting extended length shade tubes.

Conventional shade systems typically include two mounts and a shade tube assembly supported on both ends by mounts for supporting the weight of the shade tube assembly. Shade tube assemblies typically include a shade tube and a shade or screen configured to extend and retract to selectively provide shade. Some shade systems may also include other components, such as a motor in the case of an automatic tube roller system. In some shade systems, it is desirable to provide a shade over a large area (e.g., over an area nine feet in length). In such instances, several individual shade tubes can be mounted side-by-side to span the distance (e.g., two separate four-and-one-half foot shade tubes, or three separate three foot shade tubes), or a single shade tube may be installed (e.g., a single nine foot shade tube). However, when shade tubes reach certain lengths (e.g., over nine feet), the shade tube assembly may become too heavy for the mounts on both ends of the shade tube assembly, thereby causing the shade tube and shade to deflect downward. While shade tubes can be installed in sections of nine feet or less to prevent deflection, it may be ideal to have a single uniform shade extending a length longer than nine feet. To adequately support shade tubes of certain weights, such as those shade systems having lengths extending beyond nine feet or particularly heavy shades, additional support is needed along the length of the shade tube (e.g., at least near a mid-point of the shade tube). However, current systems for supporting such extended length shade tube assemblies require fascia and complex brackets that require gaps between shades, or that otherwise create visually unpleasing shade assemblies that require complex installations.

SUMMARY

One embodiment relates to a shade bracket and support system. The shade bracket and support system includes a shade, a shade tube, at least two bracket assemblies, and a plurality of roller assemblies. The shade is movable between a retracted position and an extended position. The shade tube is coupled to the shade and is configured to rotate in a first direction to retract the shade and a second direction to extend the shade. The at least two bracket assemblies are configured to mount to a structure and support the shade tube and shade. The plurality of roller assemblies are provided between the bracket assemblies and are configured to support the shade and the shade tube along a longitudinal axis of the shade tube. At least one of the roller assemblies is configured to rotate in the same direction as the shade tube when the shade is being retracted or extended.

Another embodiment relates to a bracket system for mounting a shade tube assembly. The bracket system includes an upper portion of a bracket, a lower portion of a bracket, and a coupling mechanism. The upper portion of the bracket is configured to mount to a ceiling. The upper portion comprises a recessed portion. The lower portion of the bracket includes an aperture extending along a vertical axis of the lower portion. The lower portion is configured to support a plurality of roller assemblies, and the plurality of roller assemblies are configured to support a shade tube assembly along a longitudinal axis of the shade tube assembly. The shade tube assembly comprises a shade tube and a shade coupled to the shade tube. The coupling mechanism is configured to removably lock the lower portion to the upper portion. The aperture houses the coupling mechanism, and the recessed portion is configured to receive an end of the lower portion such that the aperture aligns with the recessed portion when the lower portion is locked with the upper portion.

Another embodiment relates to a method of installing a shade tube assembly. The method includes fastening at least three upper portions of a bracket to a ceiling. The method further includes removably coupling, for each of the at least three upper portions, a lower portion of the bracket to the upper portion, and removably coupling the lower portion to the upper portion includes locking the lower portion in an installed position by locking the lower portion into a recess of the upper portion. The method further includes unlocking, for each bracket, the lower portion from the upper portion by applying a downward force to the lower portion to unlock the lower portion from the recess of the upper portion. The method further includes laterally rotating the lower portion at least 90 degrees from the installed position with respect to the upper portion. The method further includes lifting a shade tube assembly above a support portion of each of the lower portions of the bracket. The method further includes laterally rotating the lower portion at least 90 degrees back to the installed position. The method further includes coupling at least three shade roller assemblies between each of the brackets.

DETAILED DESCRIPTION

Figure 1A:
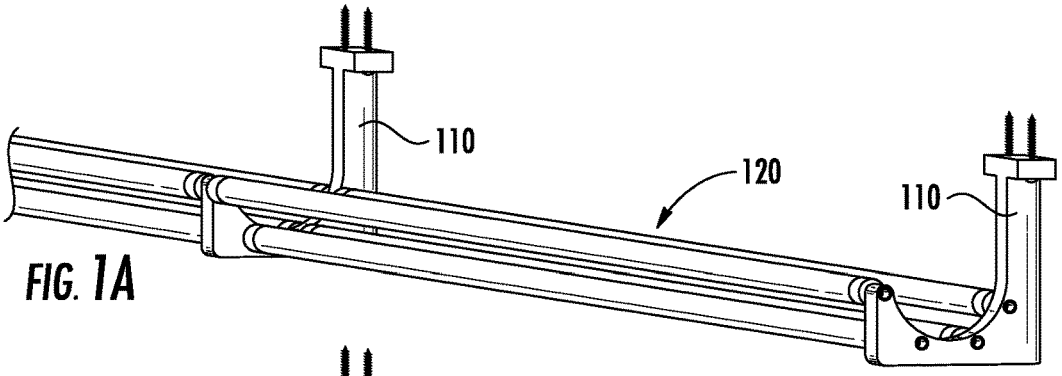
FIGS. 1A-1D are diagrams of a shade bracket and support system, according to an example embodiment.
Figure 1B:
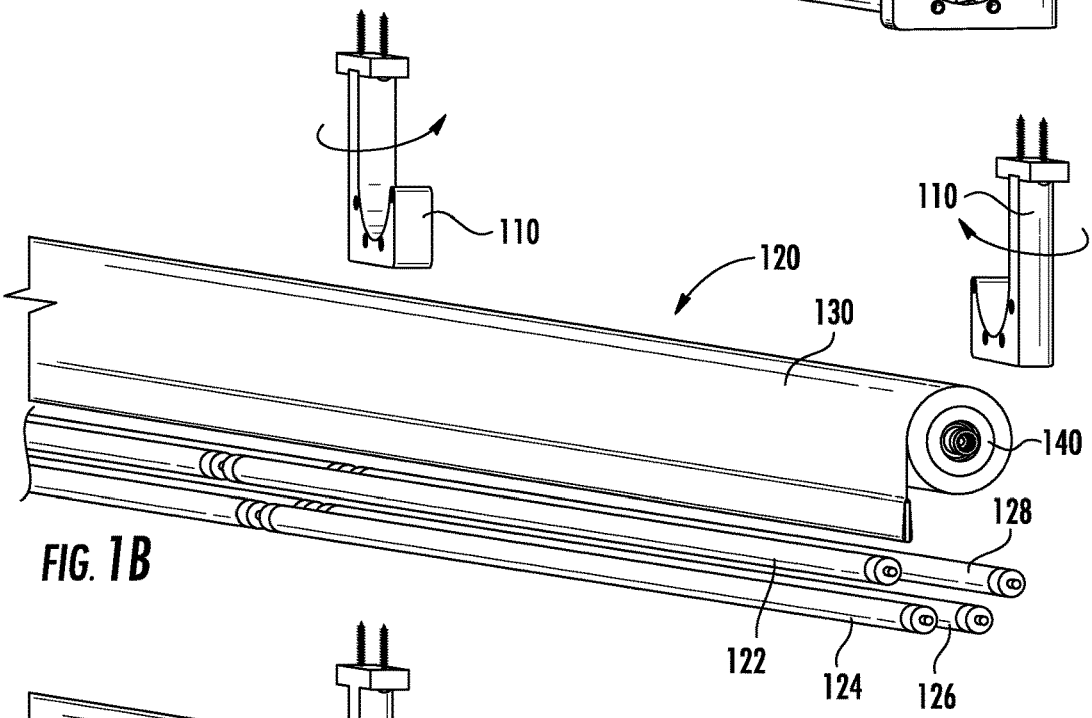
Figure 1C:
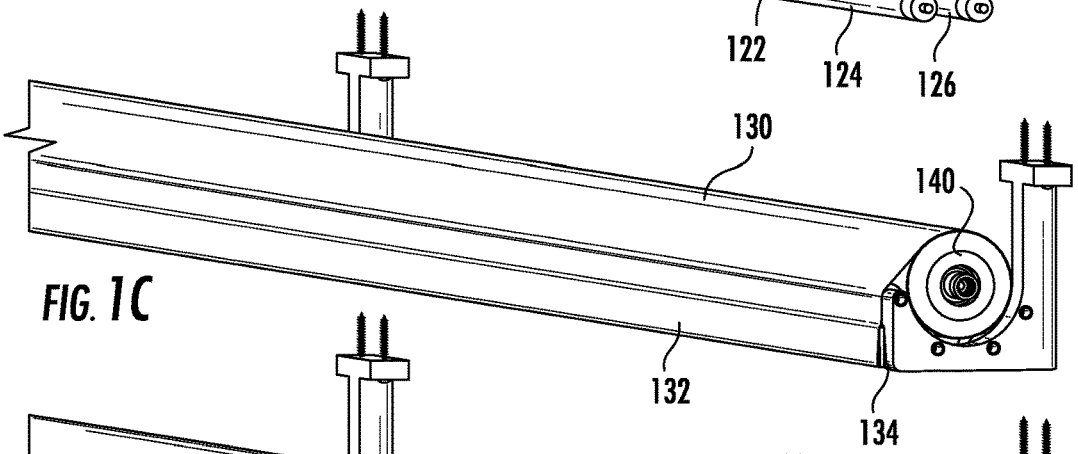
Figure 1D:
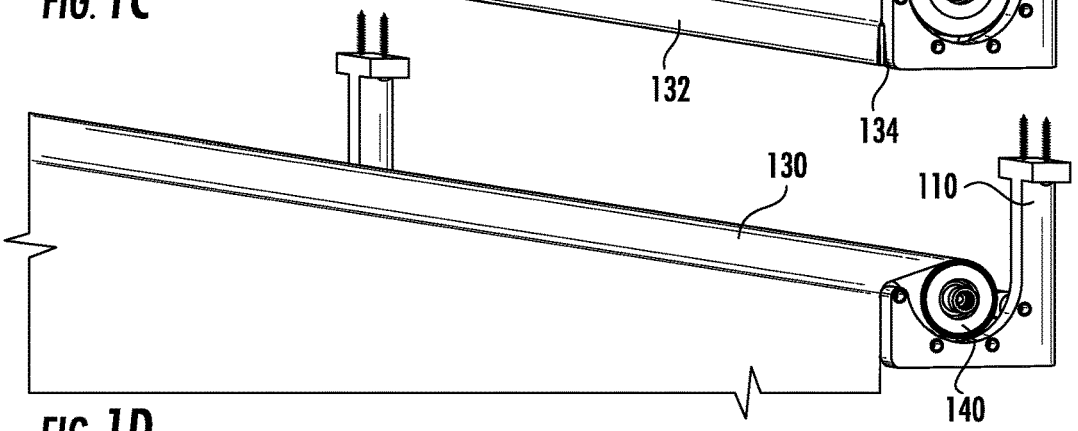

Referring to the figures generally, the systems, methods, apparatuses, devices, technologies, and techniques (hereinafter referred to as the "system"), described herein, enable shade tubes and shades or screens of extended lengths to be supported at a plurality of locations along the length of the shade tubes to prevent the shade tubes from deflecting while at the same time providing a single, uninterrupted shade along the entire length of the shade tube. The system may provide motorized retraction and deployment of the shade in a uniform way by providing an equal pressure to the shade across the length of the shade tube. The various configurations of the extended length shade system enables the shade to be rolled tighter than convention systems when retracting, thereby minimizing the area consumed by the shade system when installed. The components illustrated in the figures are provided for explanatory purposes only and are not intended to limit the inventive concepts disclosed herein in any way. For example, extended length shade systems may include additional components, fewer components, different components, or differently arranged components than those illustrated in the figures. Also, in some implementations, one or more of the components of the extended length shade systems disclosed herein may be described as being performed by other components of the extended length shade system.

Referring now to FIGS. 1A-1D, diagrams of an example extended length shade system 100 are shown according to an example embodiment. The system 100 includes at least one bracket assembly 110, at least one roller assembly 120, a shade 130 and a shade tube assembly 140. The components of system 100 may be formed of a material of sufficient rigidity and strength to support the weight of bracket assembly 110, roller assembly 120, shade 130, shade tube assembly 140, including any static or dynamic loads (e.g., forces, torques, tensions, compressions, etc.) imparted on the system 100 by any of the components or by any external forces. System 100 may, for example, be made of a variety of materials, such as metal, plastic, Teflon®, acrylic, urethane, wood, fiberglass, composite, other materials, or any combination thereof.

The bracket assembly 110 is configured to be secured to a structure and to support components of the system 100. The bracket assembly 110 may be made of a material having a sufficient strength and rigidity that enables bracket assembly 110 to maintain a basic shape (e.g., a J-shape, etc.) when supporting an extended length (e.g., longer than nine feet) tube assembly 140 and which also enables various components to be coupled to the bracket assembly 110. The system 100 includes at least two bracket assemblies 110. For example, the bracket assemblies 110 may be arranged to provide support for the tube assembly 140 on both ends of the tube assembly. In some embodiments, the system 100 includes more than two bracket assemblies 120, and the bracket assemblies are arranged to provide support on both ends of the tube assembly 140 and on at least one location between the two ends of the tube assembly 140. In some embodiments, the bracket assemblies 110 are evenly spaced along the span of the shade (e.g., every five feet for a fifty foot shade). Alternatively, the bracket assemblies 110 may be spaced based on a fixed distance with a single bracket assembly 110 at a variable width to match the length of the shade (e.g., every eight feet, except one bracket assembly is spaced two feet from an adjacent assembly bracket 110 for a fifty foot shade) to minimize the need to customize multiple portions of the system 100. In some embodiments, the bracket assemblies 110 may be spaced to accommodate features of a structure that the bracket assemblies 110 are mounted to (e.g., a support, column, electrical wiring, etc.).

The roller assembly 120 includes a plurality of rollers configured to engage and support the tube assembly 140. In some embodiments, the roller assembly 120 includes a front roller 122, a bottom-front roller 124, and a bottom roller 126. The roller assembly 120 may optionally include a back roller 128. The roller assembly 120 may include components to rotatably couple the rollers 122-128 to the bracket assembly 110 such that the rollers rotate with the tube assembly 140. In some embodiments, the rollers 122-128 are configured to rotate in the same direction and at the same speed as the tube assembly 140. In some embodiments, rollers 122-128 are cylindrical in shape and hollow. It will be appreciated that the rollers 122-128 may have a profile of any shape and that the rollers 122-128 are not limited to being hollow. For example, in some embodiments, at least one of the roller 122-128 is solid. For example, the rollers 122-128 may be circular, elliptical, triangular, square, pentangular, hexangular, octangular, etc. In some embodiments, at least one of the rollers 122-128 has a shape different from at least one of the other rollers 122-128.

In some embodiments, shade 130 is coupled to and wound around shade tube assembly 140 by any known technique in the art such that rotation of the shade tube assembly 140 in a first direction causes free end 132 of shade 130 to move away from the shade tube assembly 140 and that rotation of the shade tube assembly 140 in a second direction opposite the first direction causes free end 132 of shade 130 to move towards the shade tube assembly 140, thereby extending or retracting the shade from a stowed or retracted position to an extended position. In some embodiments, the free end 132 of shade 130 may include a shade weight 134. Shade weight 134 may be a continuous weight spanning the length of shade 130. In some embodiments, the shade weight 134 is configured to keep shade 130 steady and to uniformly apply tension on the shade 130 during retraction and deployment of the shade 130. Shade 130 may be made of any material known in the art of suitable properties (e.g., strength, density, transparency, opaqueness, etc.) and may also, or alternatively, be made of a pliable and flexible material that is suitable to be controlled (e.g., bent, conformed, curved deformed, etc.) by the shade bracket and support system 100. While FIGS. 1A-1D describe system 100 as including a single shade 130, other implementations of the system 100 may include any number of shades and shade tube assemblies. For example, the system 100 may include two shades on a single shade tube, or two shades and two shade tube assemblies that abut one another.

Figure 2A:
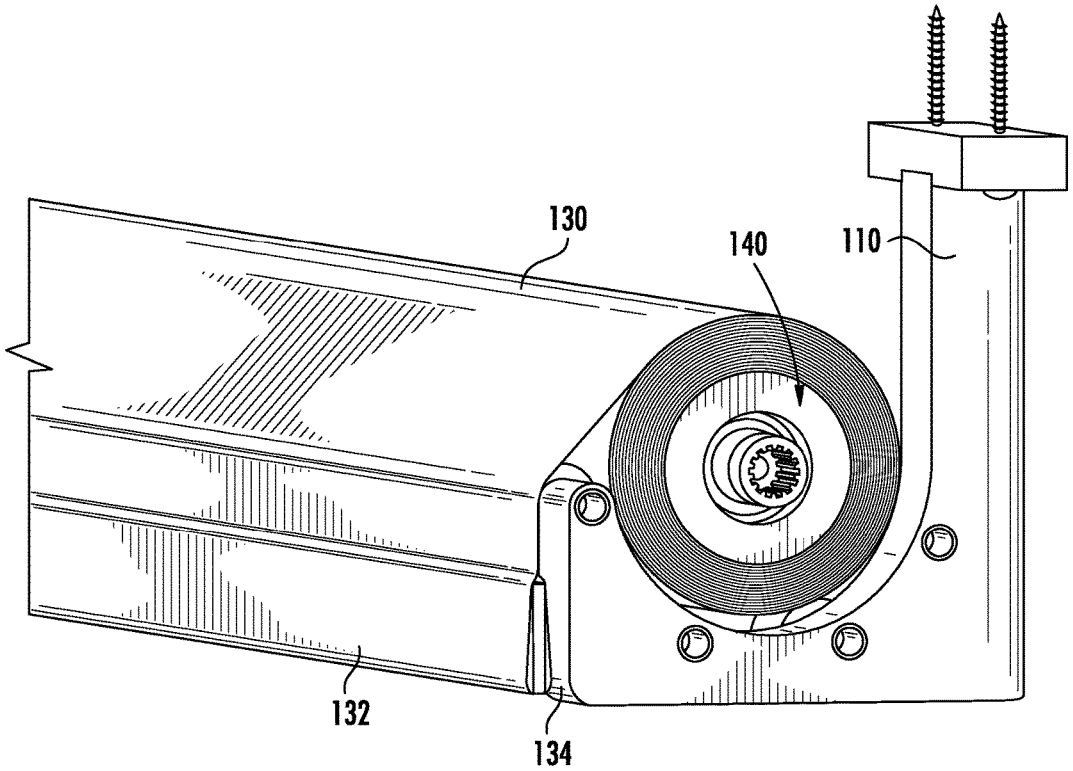
FIGS. 2A-2B are diagrams of a first end bracket assembly of the example shade bracket and support system of FIGS. 1A-1D including an idler connector with the shade in a stored position.
Figure 2B:
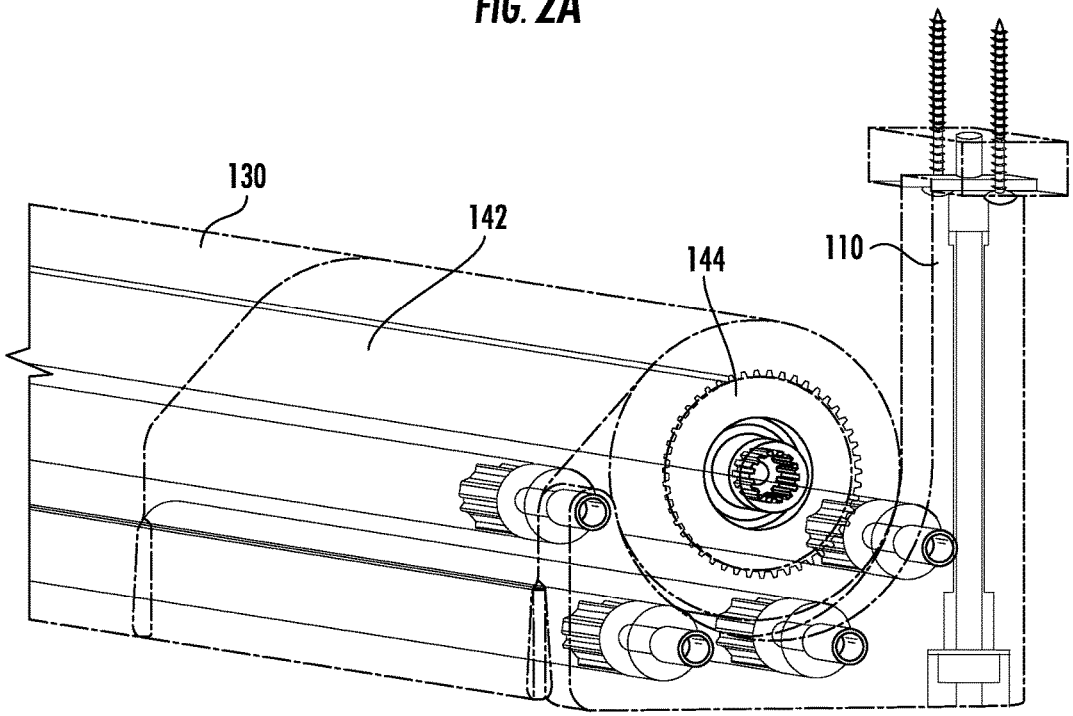
Figure 2C:
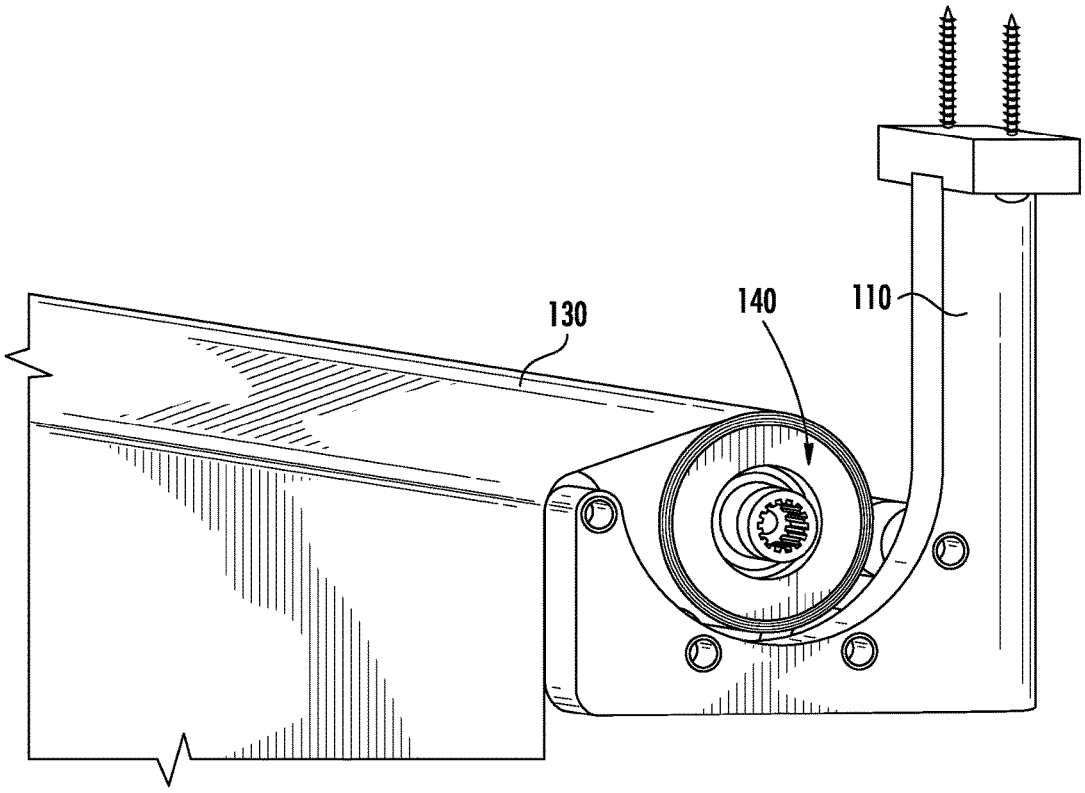
FIGS. 2C-2D are diagrams of the first end bracket assembly of the example shade bracket and support system of FIGS. 1A-1D including the idler connector with the shade in a deployed position.
Figure 2D:
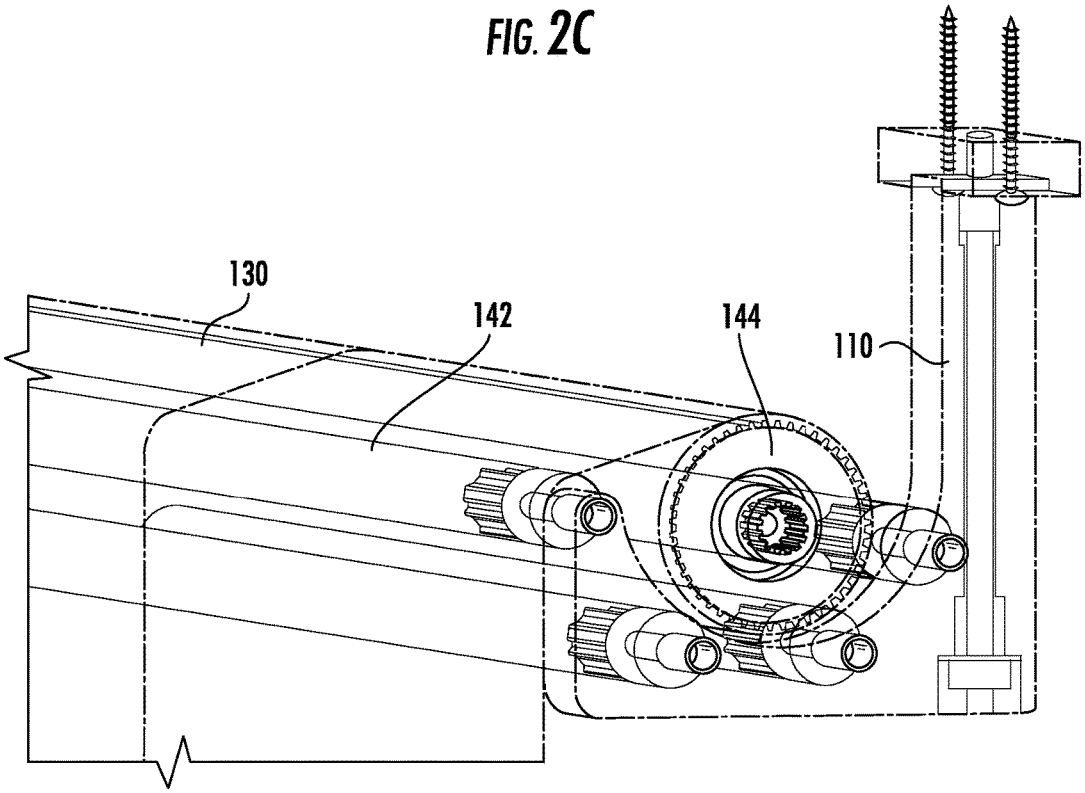

Referring now to FIGS. 2A-2D, FIGS. 2A-2B are diagrams of a first end bracket assembly 110 of the shade bracket and support system of FIGS. 1A-1D including an idler connector with the shade 130 in a stored position according to an example embodiment. FIGS. 2C-2D are diagrams of the first end bracket assembly 110 of the shade bracket and support system of FIGS. 1A-1D including the idler connector with the shade 130 in a deployed position according to an example embodiment.

Shade tube assembly 140 includes a shade tube 142 and an idler connector 144. Shade tube assembly 140, and components thereof, may include material of sufficient rigidity and strength to support the weight of shade 103 and any static and dynamic loads (e.g., forces, torques, tensions, compressions, etc.) applied to shade tube assembly 140 by shade 130, bracket assembly 110, and any other components (e.g., a control mechanism) mounted to shade bracket and support system 100. For example, the shade tube assembly 140 may be made of metal, plastic, Teflon®, acrylic, urethane, wood, fiberglass, composite materials, other materials, or some combination thereof. The strength and rigidity of the material may enable the shade tube assembly to maintain a basic shape (e.g., a cylindrical shade) and not deform under loads when being used. Shade tube assembly 140 may be generally cylindrical in shape and hollow. However, the shade tube assembly may have a profile of any shape, such as circular, elliptical, triangular, square, pentangular, hexangular, octangular, etc. and may be hollow or solid.

Idler connecter 144 may be configured to be temporarily or permanently secured to an end of the shade tube 142. The idler connector 144 may also be configured to be temporarily or permanently secured to an idler mount. Idler connector 144 may be secured to the idler mount by any means know in the art (e.g., glued, screwed, nailed, threaded engagement, etc.). Idler mount may be temporarily or permanently secured to a member of a structure (e.g., joist, beam, ceiling beam, ceiling joist, roof truss, wall stud, top, bottom, or side wall of a recess, any other joist, beam or stud) and any other portion of a structure sufficient to secure the idler connector 144 and idler mount in place. The idler mount may temporarily or permanently secured via any means known in the art (e.g., screw, nail, glue, Velcro®, epoxy, etc.). Additionally, the idler connector 144 may include a mechanism (e.g., key, pin, groove, slot, tab, etc.) that interlocks with a bearing of the idler mount. Idler connector 144 and the idler mount guide the shade tube assembly 140 and the shade tube 142 while shade 130 is being retracted or deployed.

Figure 3A:
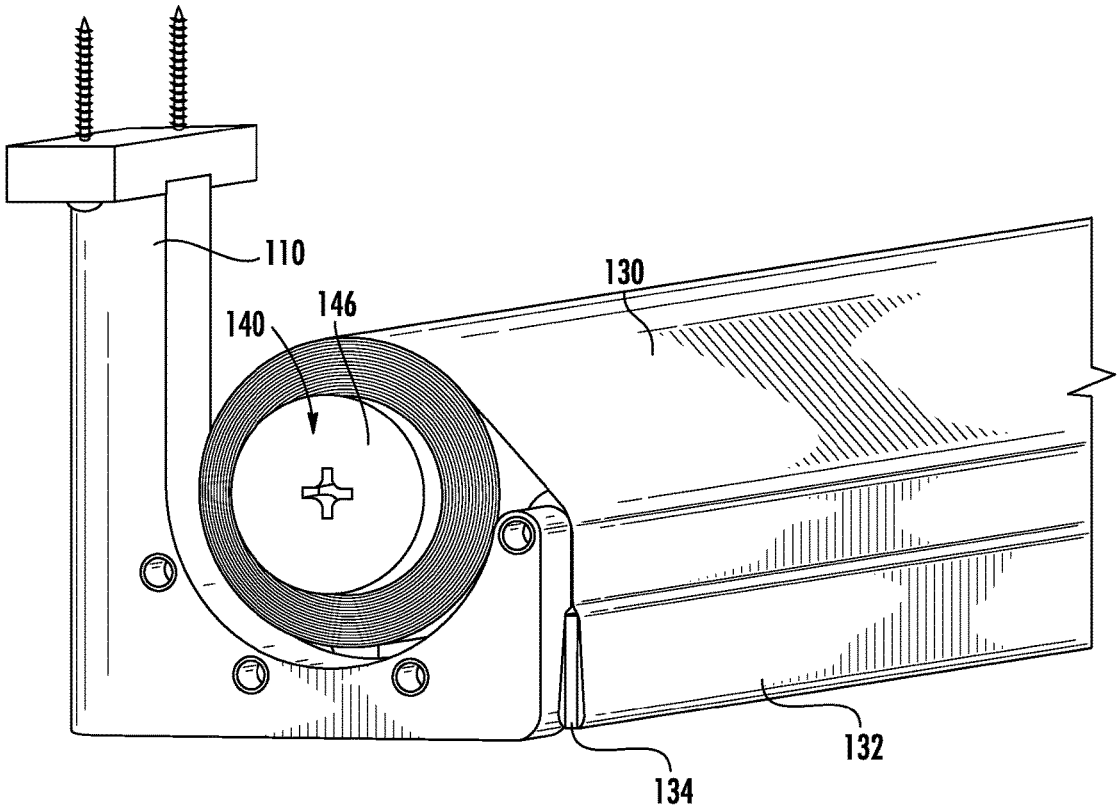
FIGS. 3A-3B are diagrams of a second end of the example shade bracket and support system of FIGS. 1A-1D including a driver connector with the shade in a stored position.
Figure 3B:
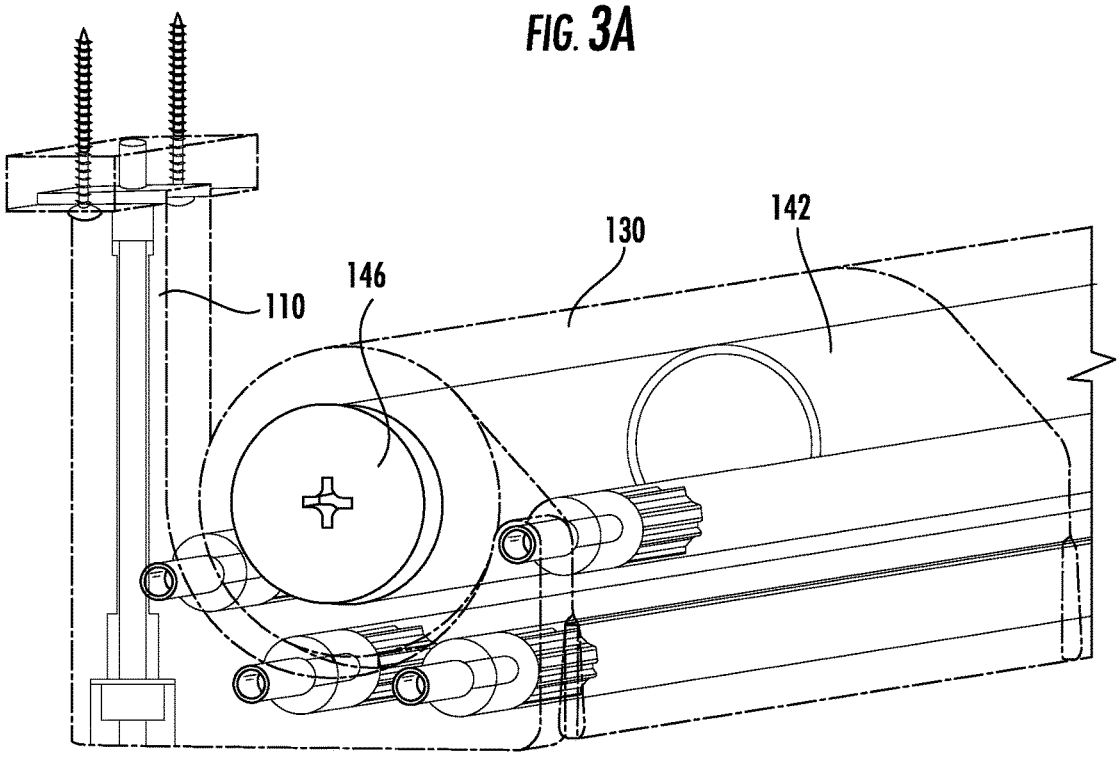
Figure 3C:
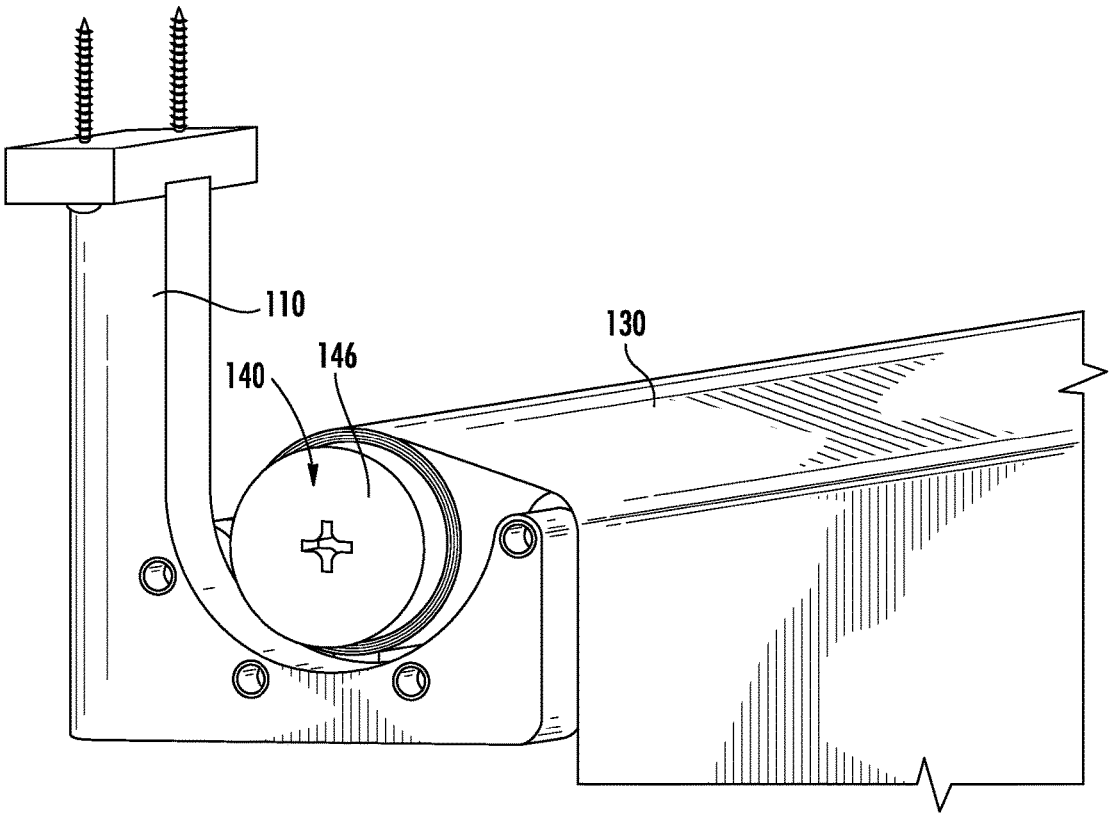
FIGS. 3C-3D are diagrams of the second end of the example shade bracket and support system of FIGS. 1A-1D including the driver connector with the shade in a deployed position.
Figure 3D:
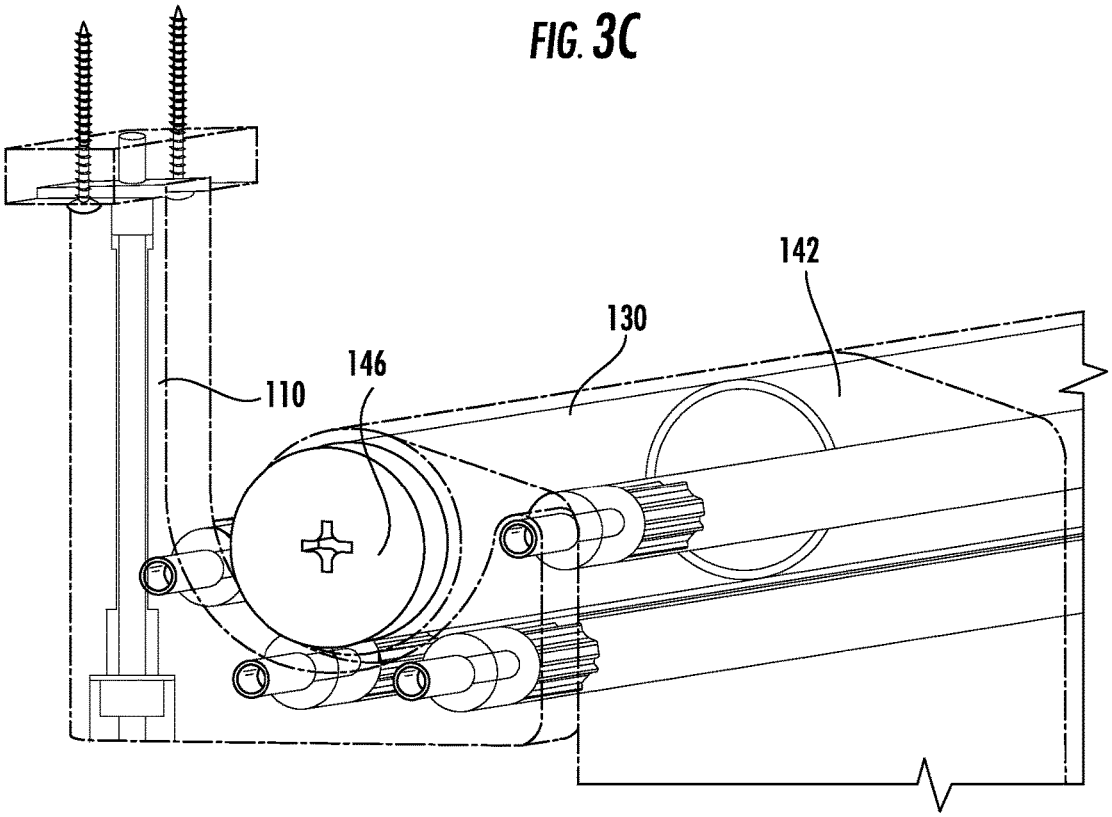

Referring now to FIGS. 3A-3D, FIGS. 3A-3B are diagrams of a second end bracket assembly 110 of the shade bracket and support system of FIGS. 1A-1D including a driver connector with the shade 130 in a stored position according to an example embodiments. FIGS. 3C-3D are diagrams of the second end bracket assembly 110 of the shade bracket and support system of FIGS. 1A-1D including the driver connector with the shade 130 in a deployed position according to an example embodiment.

Shade tube assembly 140 includes a driver connector 146 configured to temporarily or permanently secure to an end of the shade tube 142. Driver connector 146 may be located on an end of the shade tube 142 opposite the idler connector 144 such that the driver connector 146 interfaces with the shade tube 142 to cause the shade tube 142 to rotate while the idler connector 144 enables the opposite end of the shade tube 142 to rotate with minimal friction. In some embodiments, both ends of the shade tube 142 may include a driver connector 146. When both ends of the shade tube 142 include a driver connector 146, both of the driver connectors 146 may operate simultaneously to cause the shade tube 142 to rotate, one driver connector 146 may cause the shade tube 142 to rotate while the other driver connector 142 is passive (e.g., acts as an idler connector 144) but may become active (e.g., causes the shade tube 142 to rotate) if the other driver connector 142 fails, or one driver connector 142 may be a primary driver connector while the other driver connector 142 operates to cause the shade tube 142 to rotate only during a certain phase of deploying and stowing the shade 130. In some embodiments, driver connector 146 is configured to be temporarily or permanently coupled to a drive and driver mount. When shade bracket and support system 100 is installed, driver connector 146 may be secured to the driver and driver mount by any means know in the art (e.g., glued, screwed, nailed, threaded engagement, etc.), and the driver mount may be temporarily or permanently coupled to a member of a structure (e.g., joist, beam, ceiling joist, ceiling beam, roof truss, wall stud, top, bottom, or side wall of a recess, or any other structure or component thereof). The driver mount may temporarily or permanently secured via any means known in the art (e.g., screw, nail, glue, Velcro®, epoxy, etc.).

The driver and driver mount may be a control mechanism (e.g., motor, servo, air compressor, hydraulic, pneumatic, and some other mechanical control system) configured to provide a force (e.g., torque) to driver connector 146 and shade tube assembly 140 to cause shade tube assembly 140 to rotate. The control mechanism may be configured to be in wired and wireless communication with a user device (e.g., input device, keypad, PDA, phone, laptop, computer, remote control, wearable, etc.), sensor (e.g., motion, temperature, pressure, position, light exposure, etc.), and other device (e.g., timer, measurement device, light switch, door, window, televisions, etc.). The user device, sensor, and other device may be configured to send a signal to the control mechanism to automatically rotate (e.g., clockwise, counterclockwise) shade tube assembly 140 about a rotational axis of the shade tube assembly 140. Additionally, the drive connector 146 may include a mechanism (e.g., key, pin, groove, slot, tab, etc.) that may interlock with a bearing of the driver mount.

While the shade tube assembly 140 is described as having a single idler connector 144 and a single driver connector 146, any combination of connectors may be implemented. In addition, the idler connector 144 and driver connector 146 may be received by either end of the shade tube 142. For example, both ends of the shade tube 142 may be configured to receive the idler connector 144 and the shade 130 may be deployed and retracted manually. Alternatively, both ends of the shade tube 142 may be configured to receive the driver connector 146 and the shade 130 may be mechanically driven on both ends of the shade tube assembly 140.

Referring now to FIGS. 4A-4E, diagrams of the coupling mechanisms and components of the shade bracket and support system of FIGS. 1A-1D are shown according to example embodiments. Specifically, FIGS. 4A-4E show example components of bracket assembly 110 and roller assembly 120 as well as an example configuration of coupling the bracket assembly 110 with the roller assembly 120.

Figure 4A:
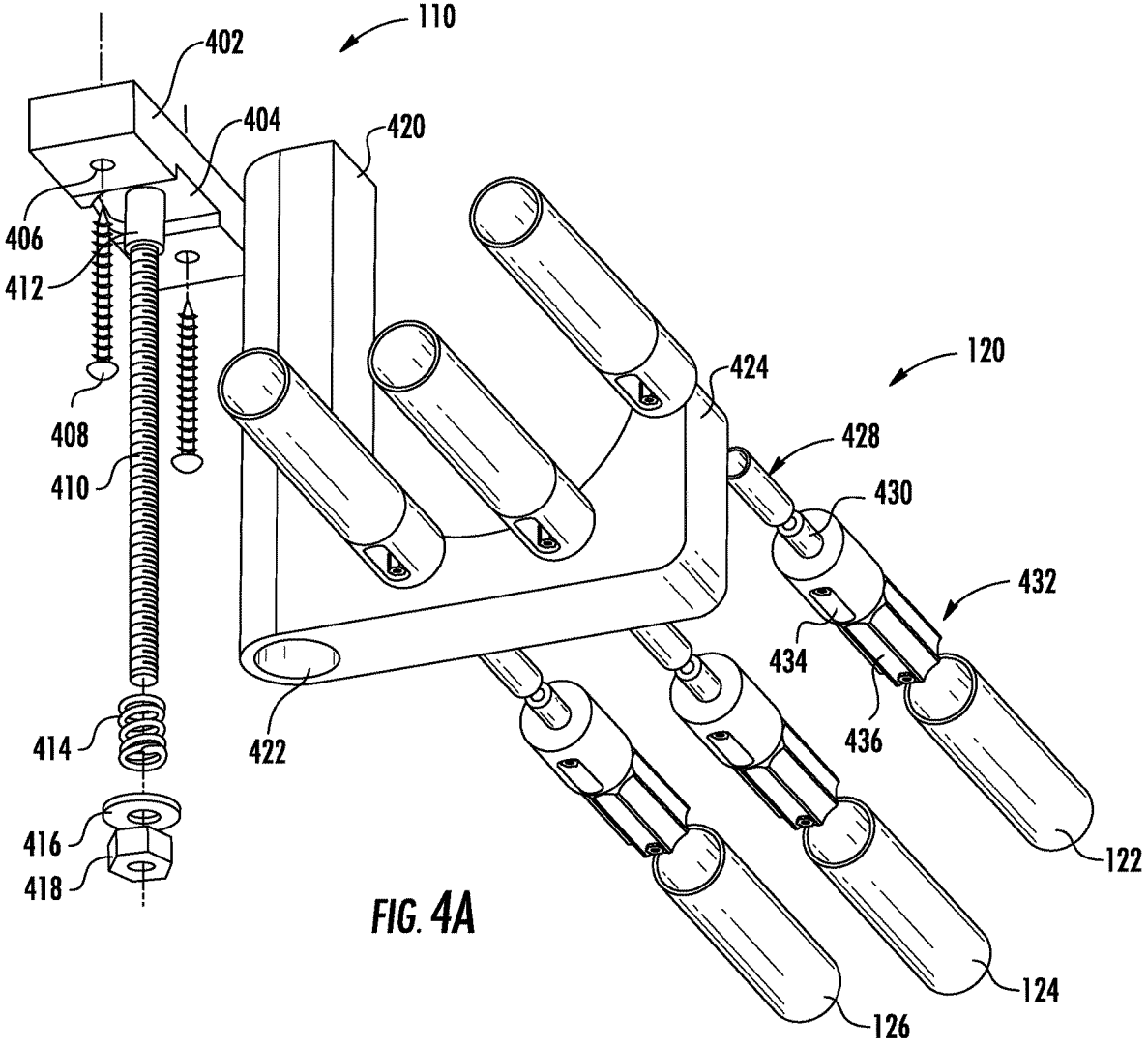
FIGS. 4A-4E are diagrams of the coupling mechanisms and components of the example shade bracket and support system of FIGS. 1A-1D.
Figure 4B:
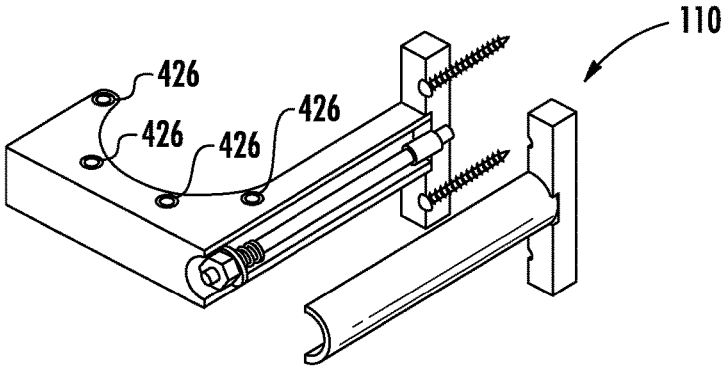
Figure 4C:
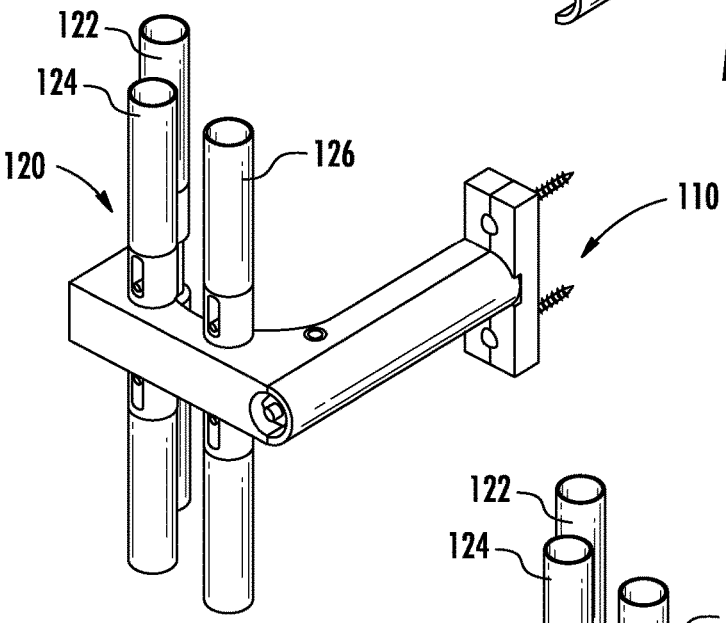

The bracket assembly 110 includes a mount 402 and a bracket 420 including a base 424 extending from the bottom of bracket 420. Mount 402 is configured to be temporarily or permanently secured to a member of a structure and any portion thereof configured to support the weight of the system 100. Mount 402 may include a notch 404 to receive and removably secure bracket 420 in place. In some embodiments, mount 402 includes at least one aperture 406 to receive a mounting screw 408. As shown in FIG. 4A, two mounting screws 408 secure the mount 402 to the member of the structure, though it will be appreciated that different types of mounting fasteners may be used to secure the mount 402 to the structure. For example, the mounting fasteners may be any type of screw, nail, bolt, or other fastener sufficient to secure the mount 402 to a structure and support the weight of the system 100.

Mount 402 may be configured to receive a bolt 410 configured to secure bracket 420 to mount 402. In some embodiments, a first end of bolt 410 is secured to mount 402 by a top nut 412. A second end opposite the first end of bolt 410 receives a spring 414, a washer 416, and a nut 418 for removably securing the spring 414 and washer 416 to bolt 410. In some embodiments, nut 418 is a locking nut but it will be appreciated that any type of nut may be used to fasten bracket 420 to mount 402. Together, spring 414, washer 416, and nut 418 are configured to removably secure bracket 410 to mount 402 while enabling the bracket 420 to rotate about mount 410.

Figure 4D:
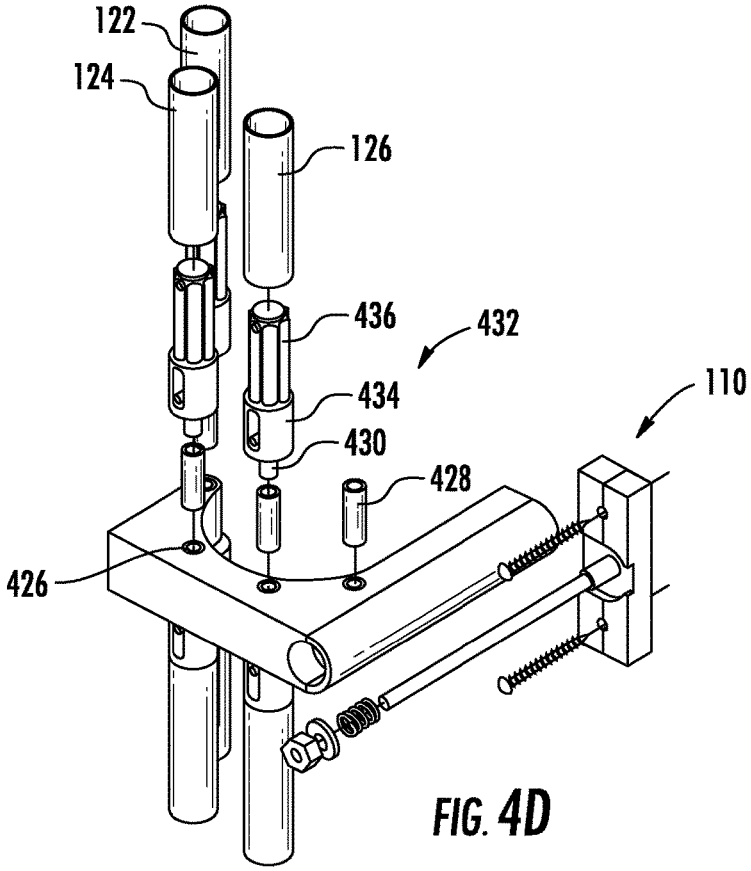
Figure 4E:
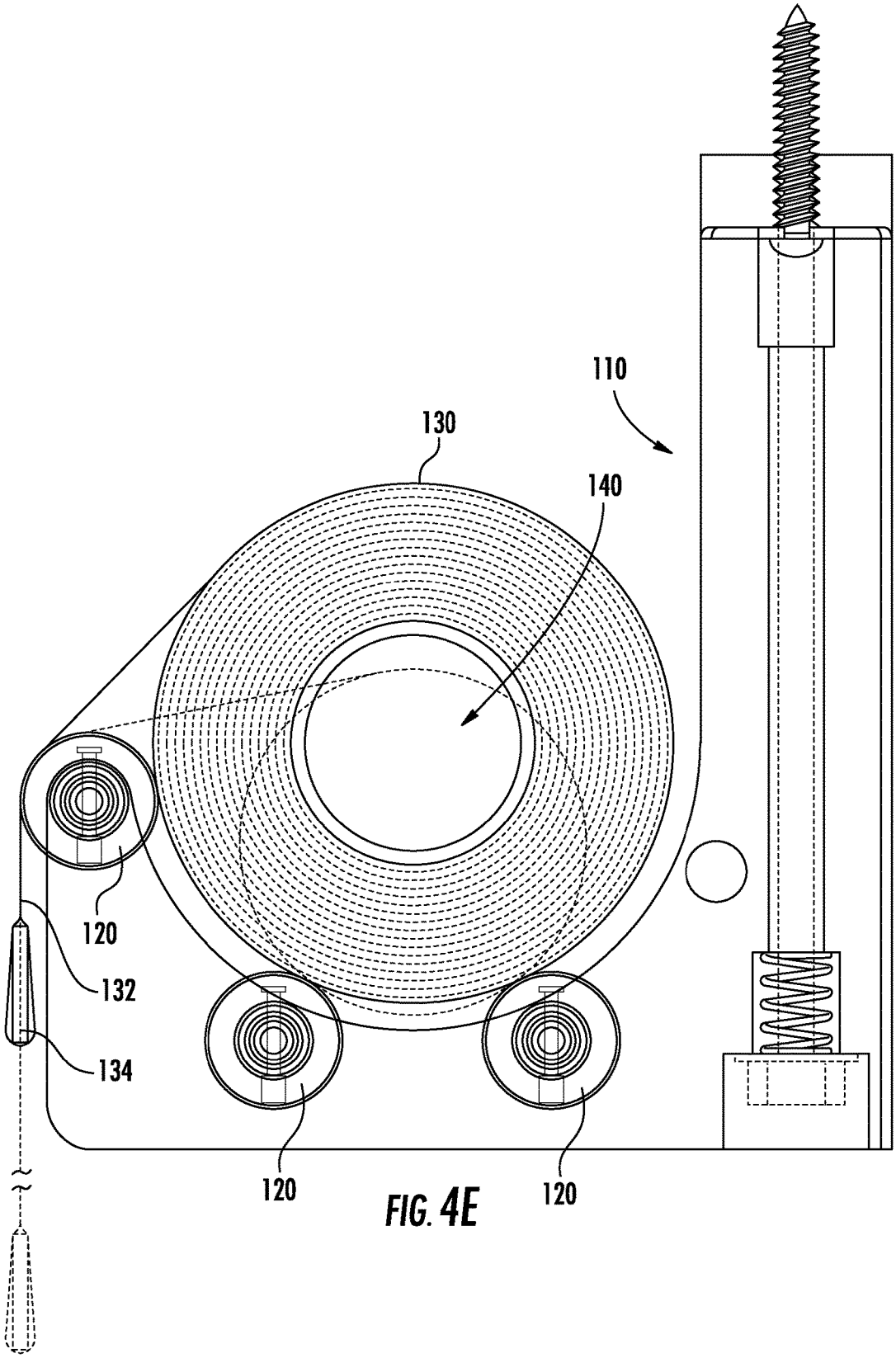

In some embodiments, bracket 420 includes a mounting aperture 422 configured couple to mount 402. Mounting aperture 422 may run the entire height of bracket 420 along a backside of bracket 420. In some embodiments, mounting aperture 422 is configured to receive bolt 410. For example, mounting aperture 422 may slide over bolt 410 and be removably secured by bolt 418 when the bracket 420 is in an installed configuration. As shown in FIG. 4E, mounting aperture 422 may have a cylindrical shape and may include sections of varying diameter. For example, mounting aperture 422 may have a first diameter size at a top end to receive the top nut 412 of bolt 410. The mounting aperture 422 may have a second diameter size smaller than the first diameter below the top end to receive the bolt 410. The mounting aperture 422 may have a third diameter larger than the first diameter at a bottom end to provide space for spring 414 and bolt 418. For example, mounting aperture 422 may include a third diameter configured to act as a ledge that interfaces with spring 414 when bracket 420 is removably secured to the mount 402. In some embodiments, mounting aperture 422 may include a fourth diameter larger than the third diameter at the bottom end of to receive washer 416 and nut 418. Washer 416 may abut a ledge created by the increase in diameter from the third portion of the aperture 422 receiving spring 414 to the fourth portion of the receiving washer 416 and nut 418. The configuration of the mounting aperture 422, mounting components 410-418 and the notch 404 in mount 402 enable bracket 420 to rotate with respect to mount 402.

To rotate bracket 420 with respect to mount 402, bracket 420 is pulled downward away from mount 402 (e.g., by pulling downward on base 424), which causes bracket 420 to move away from mount 402 and spring 414 to compress. Once bracket 420 is lowered enough such that the top of bracket 420 is clear of notch 404 below mount 402, bracket 420 can be fully rotated in either direction and held in or released in to rest in another position so that shade tube assembly 140 may be lifted into place, and then bracket 420 may be rotated underneath shade tube assembly 140 to interface with and support shade tube assembly 140. The same process of pulling bracket 420 downward away from mount 402 and rotating the mount 420 is used to return bracket 420 to the installed position. Notch 404 is configured to align bracket 420 with other bracket assemblies 110 along the length of system 100.

Base 424 includes three or more roller couplers 426 configured to secure roller assemblies 120 to bracket 420. Roller couplers 426 may be spaced along the base 424 to ensure that when rollers 122-128 are secured to base 424, the diameter of the rollers 122-128 extends above the top edge of base 424 to interface with and provide support for shade tube assembly 140. In some embodiments, roller couplers 426 are spaced such that two bottom rollers (e.g., bottom roller 126 and bottom-front roller 124) are level with one another such that when shade 130 and shade tube assembly 140 rest on the two rollers, the weight of shade 130 and shade tube assembly 140 is evenly balanced between the bottom rollers. One roller coupler 426 may be located at a top front location of base 424 such that when shade 130 is in a retracted state, and shade 130 and shade tube assembly 140 rest on the two bottom rollers (e.g., bottom roller 126 and bottom-front roller 124) and a front roller (e.g., front roller 122), shade 130 interfaces with each of the rollers 126. Together, base 424 and roller couplers 426 are configured to ensure shade 130 and shade tube assembly 140 are secured within base 424 on rollers 122-126 so that during retraction and deployment of shade 130 the risk of shade 130 and shade tube assembly 140 of falling off rollers 122-126 and bracket 120 is prevented. Base 424 may include additional roller couplers with corresponding rollers, such as a fourth roller coupler 426 located on a back portion of base 424 to receive back roller 128. In some embodiments, back roller 128 and corresponding coupler 426 may not assist in retracting or deploying shade 130 but instead provides additional support for shade tube assembly 140. For example, if shade tube assembly 140 shifts towards the back of base 424 of bracket 420 and no longer rests on bottom-front roller 124, the shade tube assembly 140 may not be able to deploy or retract, or may deploy or retract incorrectly.

Roller couplers 426 may be configured to each receive a roller assembly 120. Roller assembly 120 may include a sleeve 428, a pin 430, and a support 432. Sleeve 428 may be fully received by roller coupler 426 and lie flush with sides of base 424. For example, sleeve 428 may be a Delrin sleeve, or any type of sleeve that is slick and lubricating (e.g., nylon). Sleeve 428 may be cylindrical in shape, or of any shape that matches the shape of the roller coupler 426 (e.g., circular, elliptical, triangular, square, pentangular, hexangular, octangular, etc.). In some embodiments, sleeve 428 is configured to receive pin 430. Depending on the location of the bracket 420 (e.g., at the end or in the middle of system 100), sleeve 428 may be configured to receive two pins 430, one from either side of bracket 420. As such, sleeve 428 may be hollow or partially hollow.

Pin 430 is coupled at one end to support 432 and received on the other end by sleeve 428. As such, pin 430 may have a cylindrical shape or any other shape to match the shape of the sleeve 428 (e.g., circular, elliptical, triangular, square, pentangular, hexangular, octangular, etc.). In some embodiments, pin 430 may be configured to be easily inserted and removed from sleeve 428 (e.g., loose enough to inserted and removed by hand without additional tools) while maintaining a secure fit when received by sleeve 428. Pin 430 may be configured to be fully received by sleeve 430.

Support 432 includes a quick release component 434 and a roller bushing 436. Support 432 is coupled to pin 430 on quick release component 434 to secure one of rollers 122-128 with roller bushing 436. When pin 430 is fully received by sleeve 430, the end of quick release component 434 of support 432 may be flush with the side of base 424 of bracket 420. Quick release component 434 includes a quick release mechanism to provide an easy release of the pin 430 from the sleeve 428 (e.g., by a person using their hand and no tools). As such, quick release component 434 may include a button, lever or other component for triggering the release. In some embodiments, pin 430 may further include protrusions that are exposed and interface with the inner surface of sleeve 428 until the release trigger is pressed. When the release trigger is pressed, the protrusions move inside pin 430 to allow pin 430 to be removed from sleeve 428. Sleeve 430 may have an interior notch or notches to receive the protrusions of pin 430.

Roller bushing 436 is received by one of the rollers 122-128. The roller bushing 436 may have any shape that enables roller bushing 436 to be inserted into one of rollers 122-128. While the shape of roller bushing 436 may match the shape of rollers 122-128, it will be appreciated that the shape of roller bushing 426 does not have to match the shape of rollers 122-128. The bushing may be of a shape to be easily inserted and removed from rollers 122-128 such that the inner portion of rollers 122-128 are not in uniform contact with the roller bushing 436 (e.g., as shown in FIGS. 4A and 4D) where the roller bushing has ridges that come in contact with rollers 122-128, while the remaining outer surface of roller bushing 436 does not come in contact with rollers 122-128. Roller bushing 436 may be completely and securely received by rollers 122-128. As such, the outer diameter of the roller bushing 436 may be the same or smaller than the inner diameter of rollers 122-128. When roller bushing 436 is fully received by rollers 122-128, and when pin 430 is fully received by sleeve 428, quick release component 434 remains accessible. As such, the outer diameter of the quick release component 434 may match the outer diameter of rollers 122-128 to create a flush surface for resting shade 130 across the length of system 100.

When the system 100 is installed, two or more bracket assembly mounts may be securely coupled to at least a portion of a member of a structure. Two or more brackets may be removably coupled to the two or more bracket assembly mounts using a bolt extending through an aperture along a back portion of the bracket and held in place on the bottom of the bolt with a spring, washer, and nut, and secured in alignment via a notch in the bracket assembly mount. A force is applied to the bracket to compress the spring and remove the bracket from the notch in the bracket assembly mount while maintaining a secure coupling to the bracket assembly mount. The one or more bracket is then rotated in either direction. With the bracket in the rotated position, three or more roller assemblies may be removably coupled between each set of two brackets and a shade tube assembly 140 may be lifted above the brackets before rotating the brackets back into position. To secure the three or more roller assemblies to the brackets, the brackets are rotated back into the notch of the bracket assembly mounts. One or more tube assemblies may be set on the three or more roller assemblies. The one or more tube assembly is next connected to a control mechanism configured to cause at least tube assembly to rotate. The one or more tube assembly may, on an opposite end, be connected to an idler mechanism configured to aid at least the tube assembly in rotation. One or more shade may be securely coupled to the one or more tube assemblies such that a free end of the one or more shades may move away from and towards the tube assembly when the tube assembly is rotated. The three or more roller assemblies may be configured to aid the tube assembly in rotation. The three or more roller assemblies may also be configured to aid at least the one or more shade in retracting (e.g., rolling up) tighter by providing equal pressure across the length of the one or more shade. The system may alternatively be installed into a recess, which may be formed, for example, within a ceiling, wall, floor, or other structural element.

The components of roller assembly 120 as illustrated in the figures and described herein are provided for explanatory purposes only and are not intended to be limiting. Roller assembly 120 may include additional components, fewer components, different components, or differently arranged components than those illustrated in the figures or described herein. Also, in some implementations, one or more components of roller assembly 120 may perform one or more functions described as being performed by another one of the components of roller assembly 120.

As utilized herein, the terms "approximately," "about," "proximate," "substantially," and similar terms are intended to have a broad meaning in harmony with the common and accepted usage by those of ordinary skill in the art to which the subject matter of this disclosure pertains. These terms are intended to allow a description of certain features without restricting the scope of the features to the precise numerical ranges provided. The term "and" should not be interpreted as limiting and will be understood as meaning "additionally or alternatively."

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "front," "back," etc.) are merely used to describe the orientation of various elements in the accompanying drawings. The orientation of various elements may differ according to other exemplary embodiments, and such variations are intended to be encompassed by the present disclosure.

The construction and arrangement of the shade, shade tube, brackets and roller assemblies as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present application.

What is claimed is:

1. A bracket system for mounting a shade tube assembly, the system comprising:

a bracket;

a shade tube assembly carried by the bracket and including a shade tube;

a shade coupled to the shade tube;

an upper portion, included in the bracket, configured to mount to a ceiling, the upper portion including a recessed portion;

a lower portion, included in the bracket and configured to support a plurality of roller assemblies, wherein the plurality of roller assemblies are configured to support the shade tube assembly along a longitudinal axis of the shade tube assembly;

an aperture included in the lower portion and extending along a vertical axis of the lower portion;

a spring configured to removably lock the lower portion to the upper portion, wherein the aperture houses the spring, and wherein the recessed portion is configured to receive an end of the lower portion such that the aperture aligns with the recessed portion when the lower portion is locked with the upper portion;

wherein when the lower portion is unlocked from the upper portion, the lower portion is unlocked from the recessed portion of the upper portion, the spring is configured to compress, and the lower portion remains coupled to the upper portion by at least the spring, and when the lower portion is locked with the upper portion, the lower portion is locked with the recessed portion.

2. The system of claim 1, wherein the lower portion is configured to laterally rotate at least 90 degrees with respect to the upper portion when the lower portion is unlocked from the upper portion.

3. The system of claim 1, including at least three roller assemblies included in the plurality of roller assemblies, wherein the at last three roller assemblies are configured to support the shade assembly, and wherein a one of the at least three roller assemblies is configured to rotate in the same direction as the shade tube when the shade is being retracted or extended.

4. The system of claim 1, wherein the shade and the shade tube both have a continuous length greater than 40 feet.

5. The system of claim 4, wherein the shade tube includes a first end and a second end, and wherein the first end is configured to couple to a control mechanism.

6. The system of claim 5, wherein the control mechanism is configured to cause the shade tube to rotate along a longitudinal axis of the shade tube in a first direction to retract the shade and to rotate along the longitudinal axis in a second direction to extend the shade.

7. The system of claim 6, wherein the second end of the shade tube is configured to couple to an idler.

* * * * *